US006607182B1

(12) United States Patent
Turco et al.

(10) Patent No.: US 6,607,182 B1
(45) Date of Patent: Aug. 19, 2003

(54) WINCHING APPARATUS

(75) Inventors: Joe Turco, 27 Moorilla Avenue, Carlingford (AU), 2118; Eugene Turco, 30 Pinetree Drive, Carlingford (AU), 2118

(73) Assignees: Joe Turco, Carlingford (AU); Eugene Turco, Calringford (AU)

( * ) Notice: Subject to any disclaimer, the term of this patent is extended or adjusted under 35 U.S.C. 154(b) by 0 days.

(21) Appl. No.: 09/582,459

(22) PCT Filed: Dec. 22, 1998

(86) PCT No.: PCT/AU98/01063

§ 371 (c)(1),
(2), (4) Date: Aug. 17, 2000

(87) PCT Pub. No.: WO99/32390

PCT Pub. Date: Jul. 1, 1999

(30) Foreign Application Priority Data

Dec. 22, 1997 (AU) ..... PP 1107

(51) Int. Cl.[7] ..... B66D 1/00
(52) U.S. Cl. ..... 254/266; 254/274
(58) Field of Search ..... 254/274, 334, 254/335

(56) References Cited

U.S. PATENT DOCUMENTS

| | | | | |
|---|---|---|---|---|
| 1,752,333 A | | 4/1930 | Clark | |
| 2,232,457 A | | 2/1941 | Holland | 192/18 |
| 4,103,873 A | | 8/1978 | Sato et al. | 254/168 |
| 4,489,919 A | | 12/1984 | Ostrobrod | 254/346 |
| 4,502,667 A | | 3/1985 | Nakamura | 254/350 |
| 4,899,988 A | * | 2/1990 | Mills | 254/292 |
| 5,092,646 A | * | 3/1992 | Smallridge | 294/111 |

FOREIGN PATENT DOCUMENTS

| | | |
|---|---|---|
| EP | 0284807 | 3/1988 |
| GB | 1380604 | 1/1975 |

* cited by examiner

*Primary Examiner*—Emmanuel Marcelo
(74) *Attorney, Agent, or Firm*—Baker Botts LLP

(57) ABSTRACT

A winching arrangement is disclosed for winching a cable comprising a winching frame; a capstan (11) for winding the cable onto; a drive motor (3) for driving the capstan; and a first clutch mechanism for disengaging the capstan from the clutch when the torsional load on the cable exceeds a first predetermined limit. Preferably, the first clutch mechanism (6) is located within the capstan and ideally the clutch mechanism is an adjustable cone clutch mechanism. The winching arrangement can further include a second adjustable clutch mechanism located adjacent the motor for providing secondary disengagement of the motor from the capstan when the cable exceeds a second predetermined limit. Further, a gear reducer (8) can be interconnected between the capstan and the drive motor. Preferably, the arrangement also includes a fixing arm (15, 18) for fixing the winch to an object wherein the cable, the capstan and the fixing arm are aligned substantially concentrically during operation.

21 Claims, 23 Drawing Sheets

45
Main Shaft
Retaining Washer
Washer
Socket Screw
Lock Nut
2 Disks
Tab
Washer
46
Cone 13b
28
Cone 13a

WINCHING APPARATUS

FIELD OF THE INVENTION

The present invention relates to the field of winching systems and in particular, discloses an improved form of winch especially useful for winching cables such as optical fibre communication cables, data cables, power cables, ropes for hauling etc.

BACKGROUND OF THE INVENTION

There are obviously many uses for winching systems in society. One particular popular use of a winching system is the winching of cables such as optical fibre cables or the like through conduits by workmen in laying down cable systems. Presently, known techniques rely upon a motor system and geared arrangement for driving a capstan around which a cable or lead wire is wrapped. The capstan is then driven by the motor so as to rotate and thereby wind on the cable wire in the usual manner.

Unfortunately, presently utilised systems have a number of disadvantages. In particular, the presently utilised systems have been found to be excessively dangerous in that a wire, under tension is driven by a motor device. Minimal control is placed over the system and hence, as a result of overstressing of equipment, the wire and/or equipment can malfunction which can result in severe bodily injury to persons operating the equipment. Another common problem is overstressing of a cable when too much tension is applied to the cable. The effects applied to a cable through overstressing may in turn cause it to malfunction or to be a of a poor quality. Further, known arrangements for winching of the cables can be excessively dangerous due to imbalances and variations in the forces created by the winching arrangement when driving a cable system.

SUMMARY OF THE INVENTION

It is therefore evident that there is a long felt need for a cable hauling system which provides for a safer, more effective operation.

In accordance with a first aspect of the present invention, there is provided a winching arrangement for winching a cable comprising a winching frame; a capstan for winding the cable onto; a drive motor for driving the capstan; and a first mechanical torque limiting mechanism for disengaging the capstan from the drive motor when the torsional load on the capstan exceeds a first predetermined limit.

Preferably, the mechanical torque limiting mechanism comprises a clutch mechanism which is located within the capstan. Ideally, a cone clutch mechanism is used.

Further, their is preferably also provided a second mechanical torque limiting mechanism located adjacent the motor for providing secondary disengagement of the motor from the capstan when the load on the capstan exceeds a second predetermined limit and a gear reducer connected between the capstan and the drive motor.

The winching arrangement as can further include a fixing arm for fixing the winch to an object wherein the cable, the capstan and the fixing arm are aligned substantially concentrically during operation and a capstan support means interconnecting the capstan with a winching frame wherein non torsional forces on the capstan are communicated by the capstan support means to the frame. The capstan support means is preferably interconnected to the frame substantially concentrically with the cable, capstan and fixing arm and the fixing arm is pivotally mounted to the winching frame.

Ideally, the cone clutch is adjustable so as to set the first predetermined limit and located inside the capstan in a sealed tamperproof manner.

In accordance with a second aspect of the present invention, there is provided in a winching arrangement for winching a cable comprising a winching frame; a capstan for winding the cable onto; and a drive motor for driving the capstan, the drive motor driving having a number of active setting and the drive motor only driving the capstan at a predetermined number of the settings; a method of driving the capstan comprising the steps of: activating the drive motor and setting the motor to a non-driving setting; loading the cable on the capstan for haulage by the winching arrangement; setting the drive motor to a driving setting so as to haul the cable.

In one embodiment the number of capstan support means is two. The invention can further include a third mechanical torque limiting device which includes a latching mechanism actuated when the torsional load exceeds a third predetermined limit, the actuation being by a spring loaded strike pin which activates a switch which disables the drive motor.

In one arrangement the capstan includes an internal gear reducer unit for providing a gear reduction driving of the capstan and the capstan is liquid cooled.

In a further modification the arrangement can include a strain gauge for measuring the torsional load on the winching apparatus.

Advantageously, an external roll cage is provided of facilitating convenient and safe operation.

BRIEF DESCRIPTION OF THE DRAWINGS

Notwithstanding any other forms which may fall within the scope of the present invention, preferred forms of the invention will now be described, by way of example only, with reference to the accompanying drawings in which.

DESCRIPTION OF PREFERRED AND OTHER EMBODIMENTS

In the preferred embodiment, there is provided a winching system having a capstan with a pre-loaded cone clutch that torque limits the maximum tension or applied force on a rope or cable being hauled. Further, the capstan is arranged such that the cable is in direct alignment with a fixing device for a fixing the winch structure to a substrate or other object such as a motor vehicle. Preferably a further torque limiter can also be provided to set an overall torque limit for the device. The preferred embodiment preferably includes a radial bearing interconnected to a capstan support device which is in turn connected to the winching frame for transferring any non-torsional forces to the frame or chassis of the winch and in turn to the substrate rather than the drive train of the motor.

Figure 1:
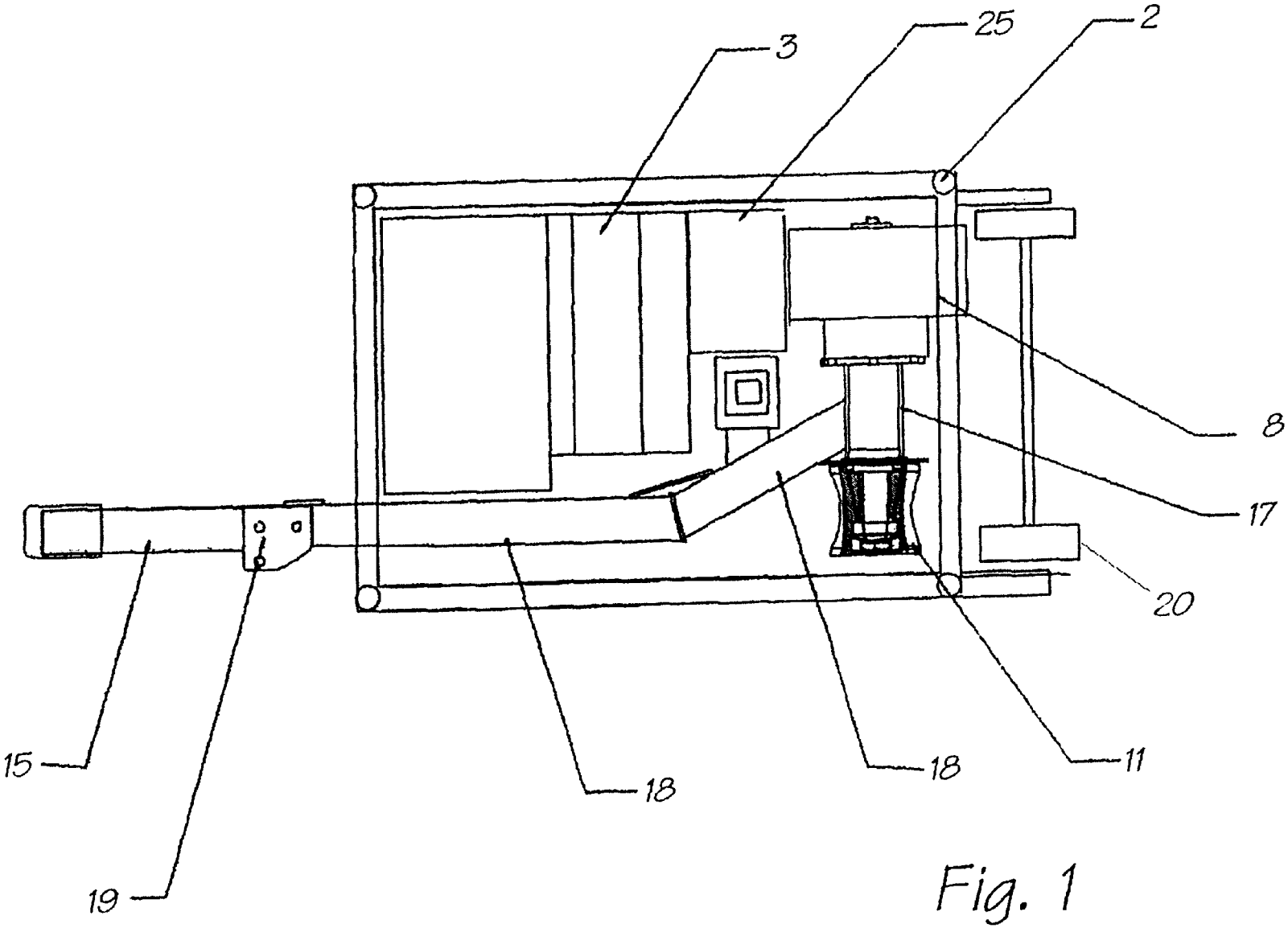
FIG. 1 illustrates a top schematic plan view of the preferred embodiment.
Figure 2:
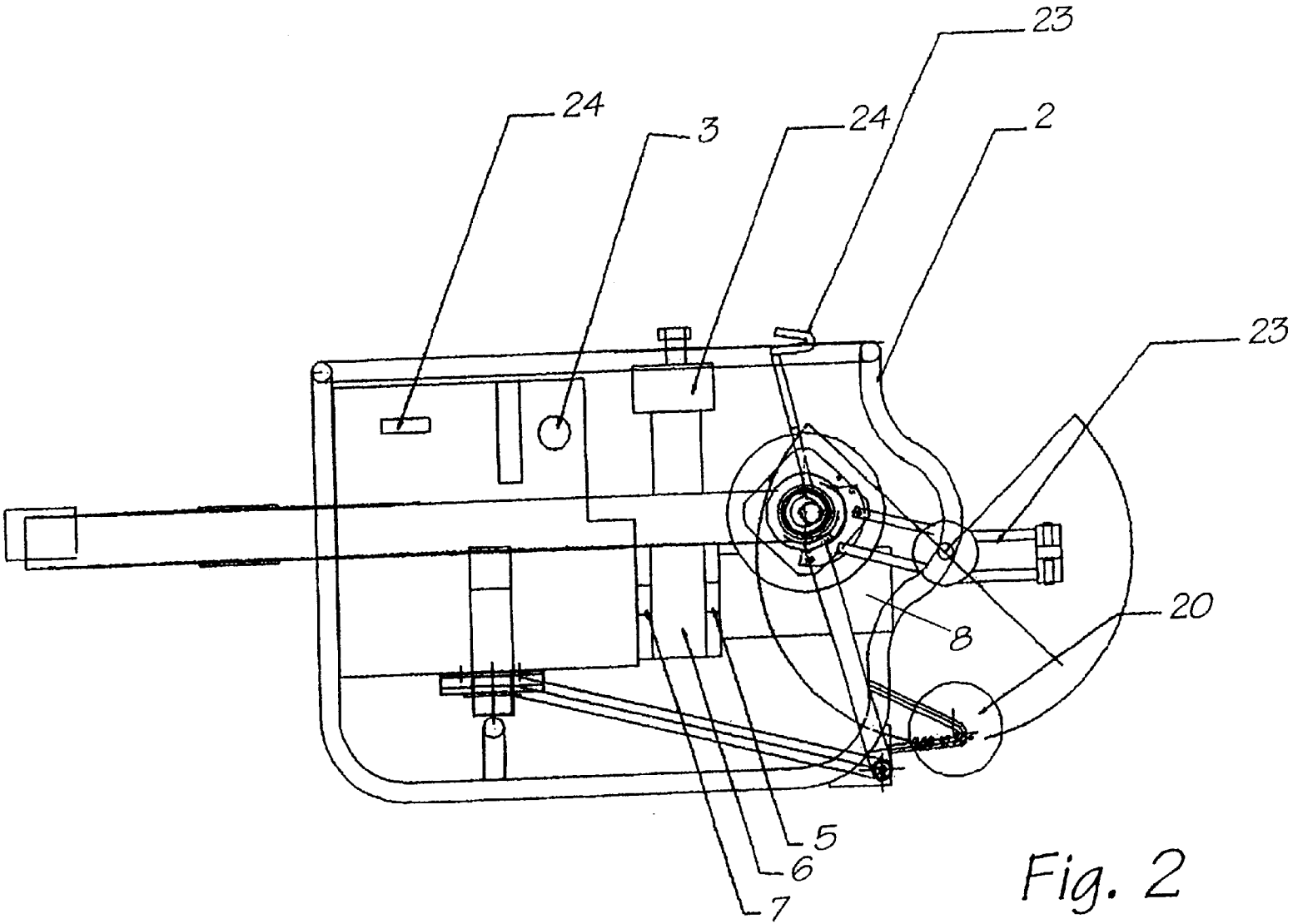
FIG. 2 illustrates a side schematic plan view of the preferred embodiment.

Turning initially to FIGS. 1 and 2, there are illustrated various plan and elevation views of the preferred embodiment 1. The preferred embodiment is mounted on a cage such as 2 and includes a motor drive device shown schematically as 3 which is attached to and drives a first shaft 7. The motor 3 can be preferably be a high end portable petrol type engine acquired in accordance with driving requirements. Preferably, the motor drive 3 is the type which includes a wet clutch mechanism such that the motor drive output is only engaged when engine revolutions exceed a predetermined limit. Such engines are readily available from several manufacturers, most notably Yamaha. A first clutch mechanism 6 is provided and acts as a secondary torque limiter which preferably has adjustable torque settings. The clutch mechanism 6 of the secondary torque limiter can be of a standard type available from several clutch mechanism manufacturers. Preferably, the clutch mechanism 6 is provided in a locked cage so that an operational supervisor is assured that a maximum tension will not be exceeded. That is, if other torque limiting devices fail and the tension on the capstan exceeds specifications set by the cable manufacturer, the secondary torque limiter of the clutch mechanism 6 can positively disengage the drive shaft 5 to a gear reducer 8 and thus the capstan. Preferably, the clutch mechanism 6 is of the type where the torque limiter, in disengaging, moves a set distance and a micro switch is actuated which automatically cuts the motor engine.

The clutch mechanism 6 has a shaft 5 which is in turn connected to a gearing system 8 which acts as a gear reducer in accordance with requirements, thus, the motor 3 can be in a geared relationship to the capstan.

The output shaft of the gear reducer 8 is interconnected to a capstan 11. The capstan 11 includes an internal cone clutch which is designed to operate to a first predetermined torque loading. The capstan 11 is located so that any cable pulled is in line with a swing arm 15. In this way, the preferred embodiment provides for a direct alignment of the torsional forces with the frame and a fixture which is preferably attached to the end of the swing arm 15.

Figure 3:
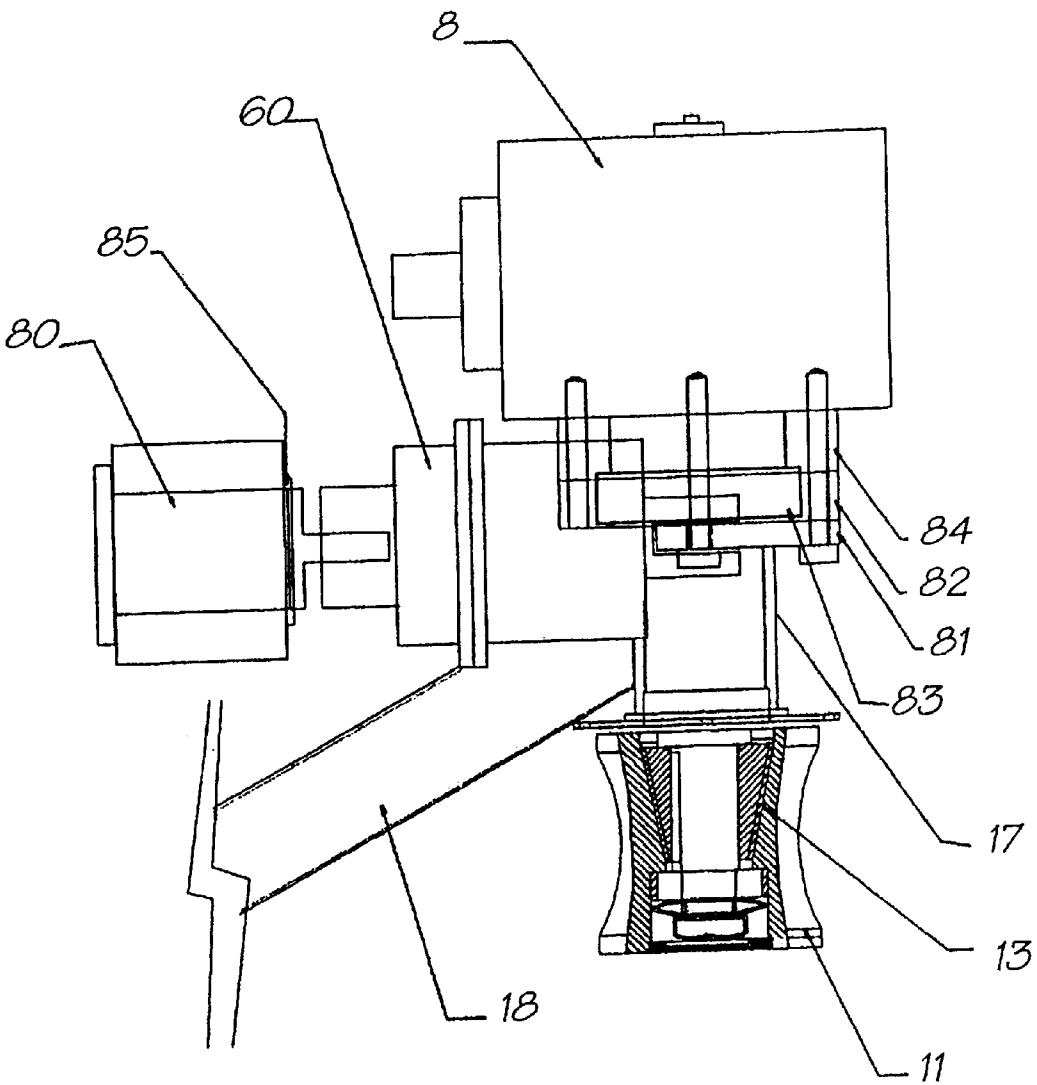
FIG. 3 is an enlarged view of the capstan and mechanical tension limiter.
Figure 4:
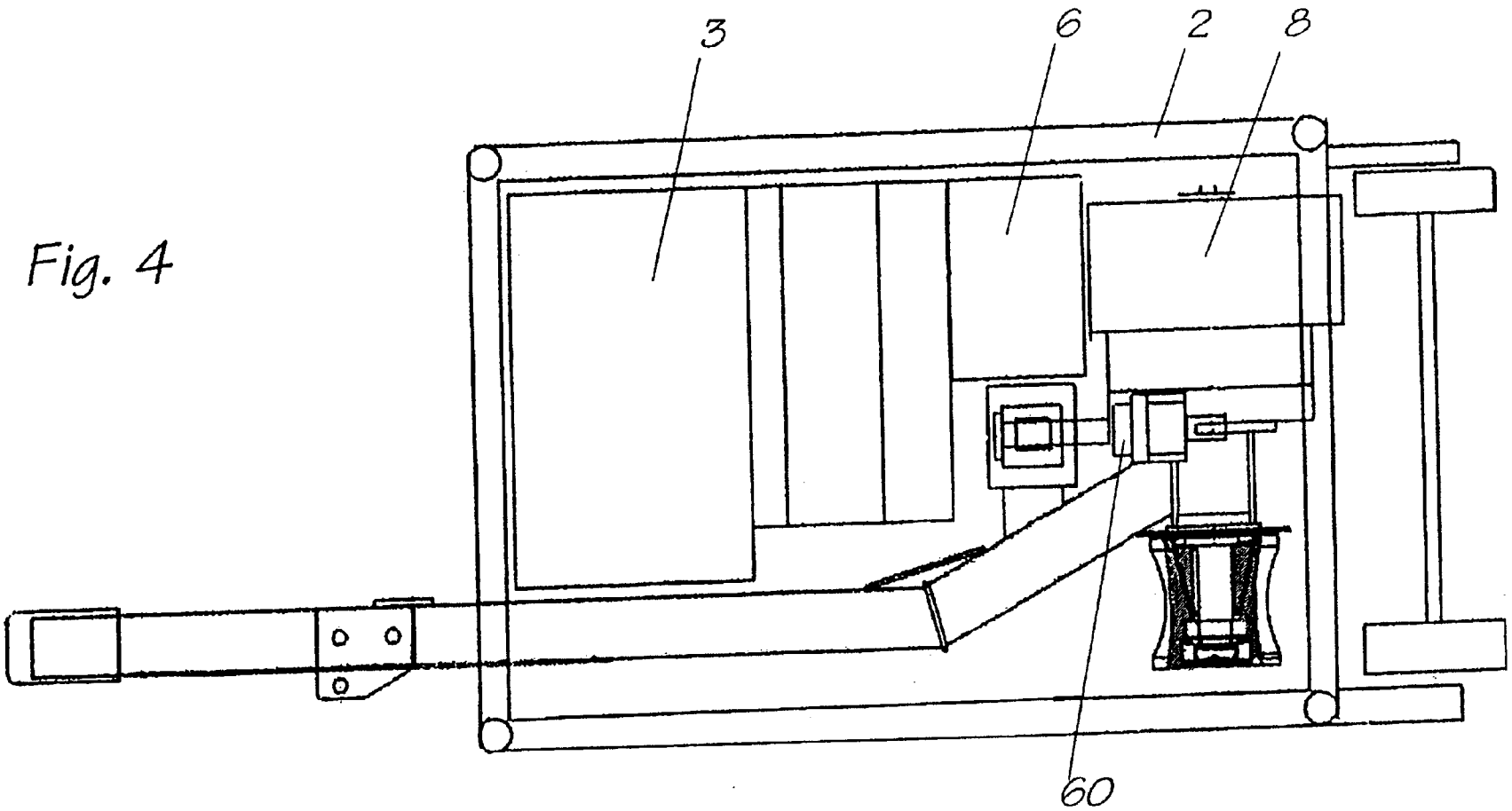
FIG. 4 illustrates a top plan view of a modified embodiment including a mechanical tension limiter.
Figure 5:
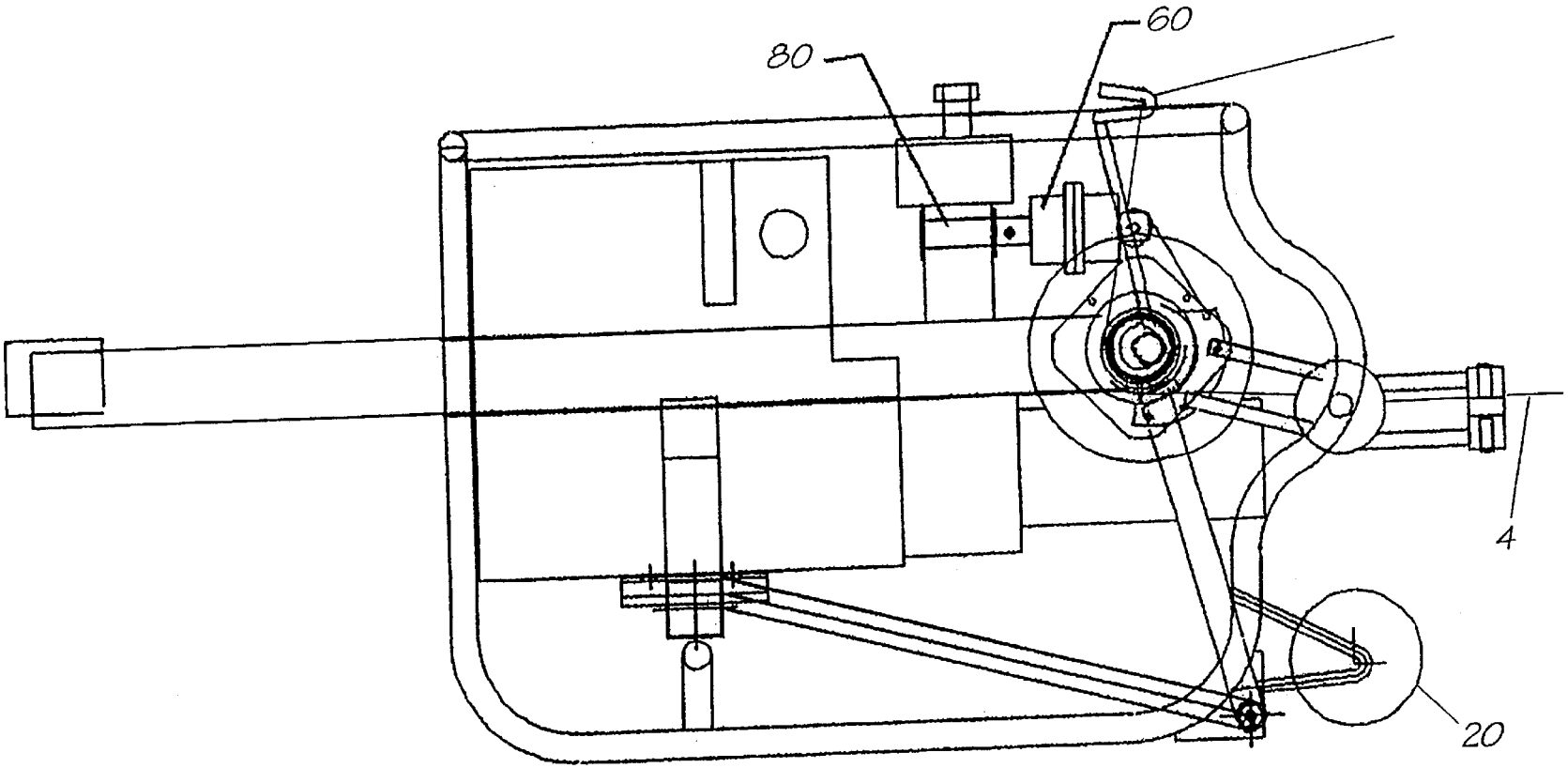
FIG. 5 is a schematic side plan view of a modified embodiment including a mechanical tension limiter.

In an alternative arrangement, an additional mechanically adjustable tension limiter is provided. This arrangement is illustrated in FIGS. 4 and 5 and includes a mechanical tension limiting device 60 that moves a set distance to actuate a microswitch that cuts the motor when the cable 4 exceeds a predetermined limit as determined via the reaction arm 80 which is secured to a swivelling gear reducer securely located on the winching frames cylinder 17. FIG. 4 illustrates a top plan view of this alternative embodiment having a swivelling gear reducer 8 and mechanically adjustable tension limiter 60 with FIG. 5 illustrating a side view thereof. In FIG. 3, there is illustrated an enlarged view of portions of FIG. 4 including the mechanically adjustable tension limiters 60. The operation of the mechanically adjustable tension limiter 60 is described hereinafter.

Returning to FIG. 1, in order to avoid any further twisting forces being placed upon gear box reducer 8, the capstan 11 includes internal radial bearings interconnecting with a cylinder 17. The cylinder 17 is affixed to the frame via strut 18 and in turn engages the swing arm 15 via pivot mount 19. The cylinder 17 is provided to transfer any non torsional forces directly to the frame via strut 18.

The chassis frame preferably includes, as illustrated in FIG. 1 and FIG. 2, a set of wheels 20 to provide for simplified transport.

Figure 6:
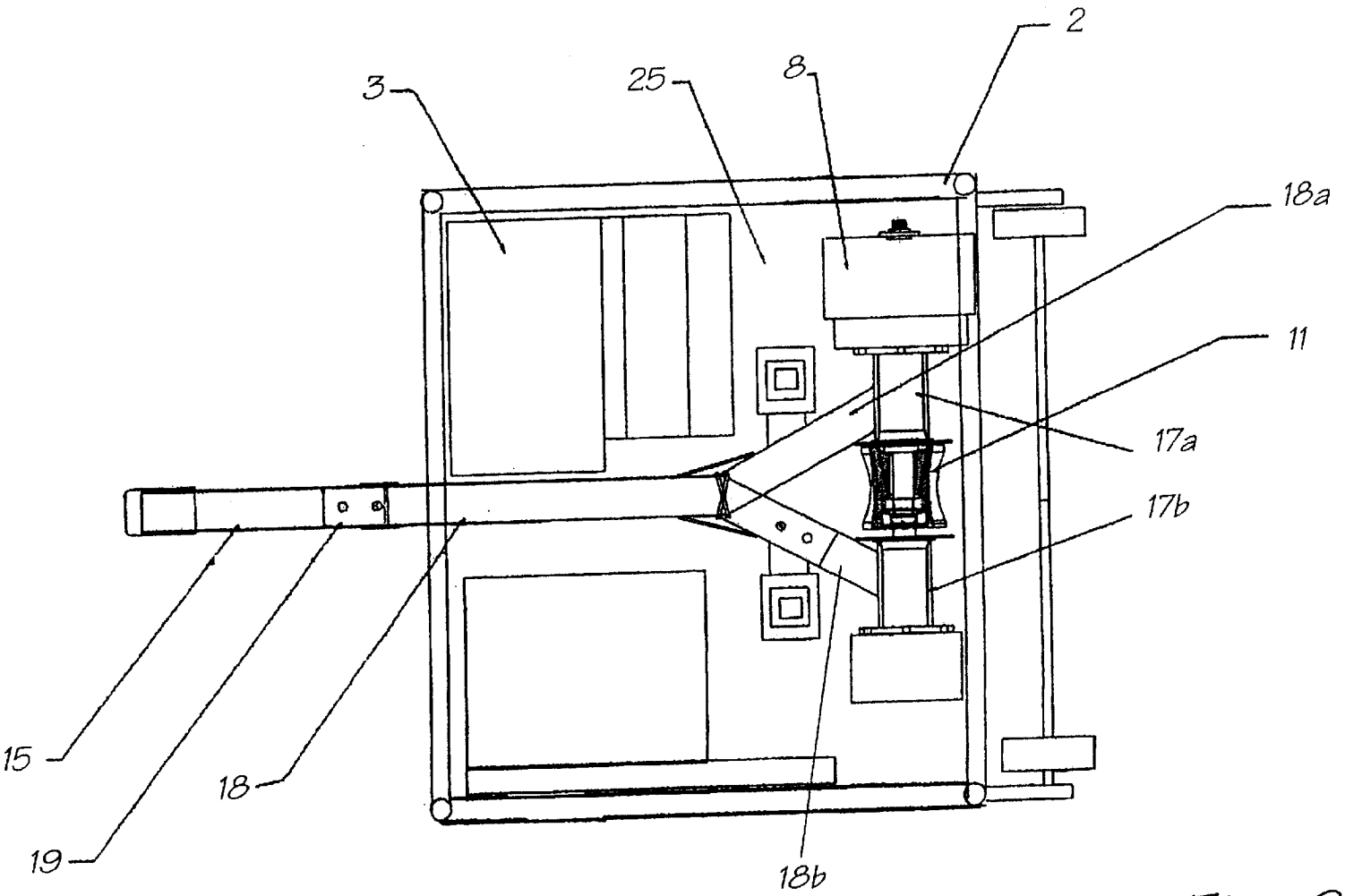
FIG. 6 is a top plan view of a further modified embodiment including dual support arms.
Figure 7:
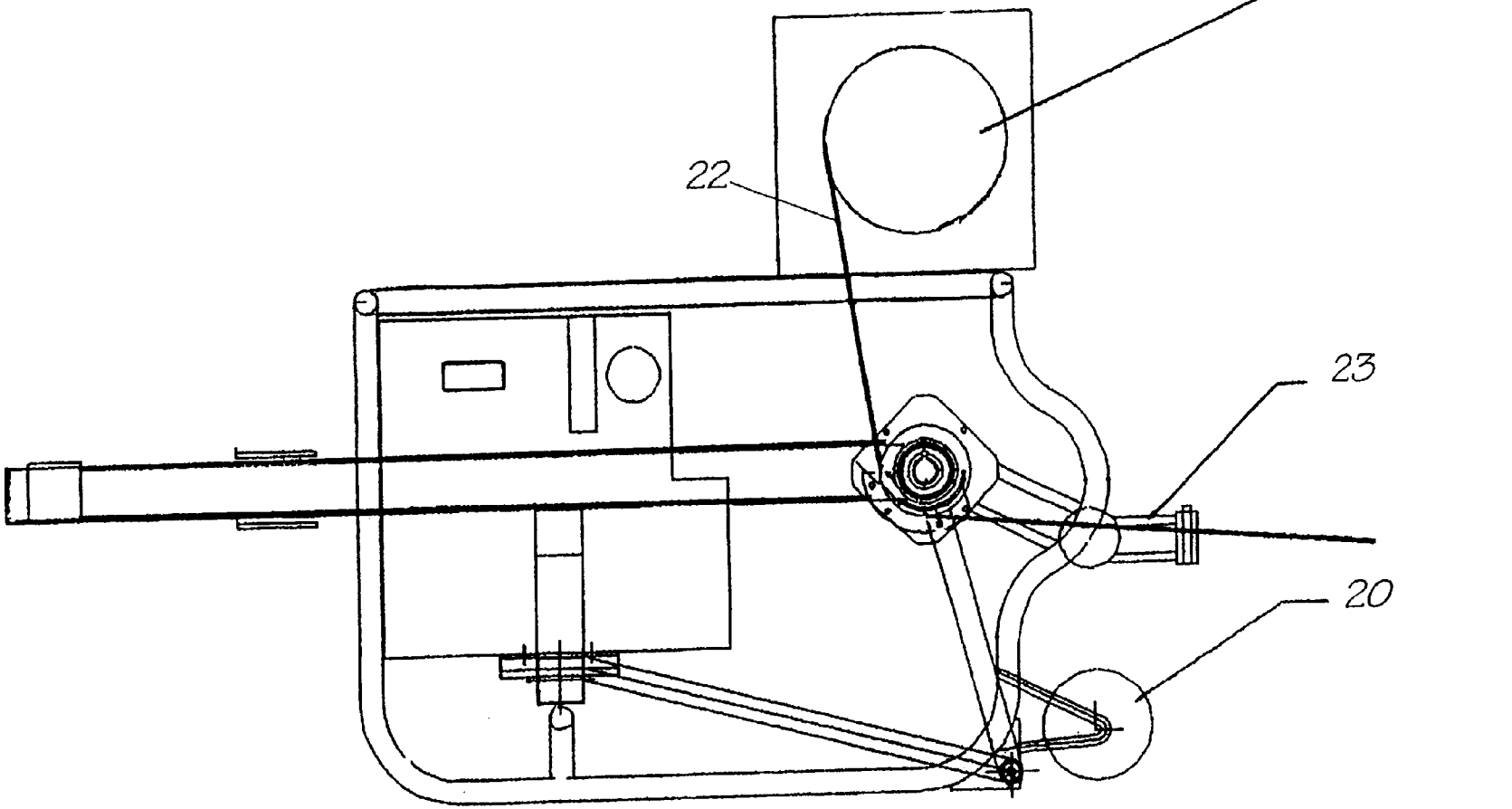
FIG. 7 is a side plan view of the modified embodiment of FIG. 6 further illustrating a wind up drum.

Other arrangements are possible for meeting different requirements. For example, FIG. 6 illustrates a top plan view and FIG. 7 illustrates a side plan view of an alternative arrangement which includes dual cylinders 17*a*, 17*b* and corresponding arms 18*a* and 18*b* and is designed for commuting large torsional loads via pivot arm 15 to a fixing point. Further, as illustrated in FIG. 7, a drum 21 is designed to take up a cable 22 being winched by the capstan. The cable 22 is fed through a feeder mechanism 23 so as to properly align the cable with the surface of the capstan.

Figure 8:
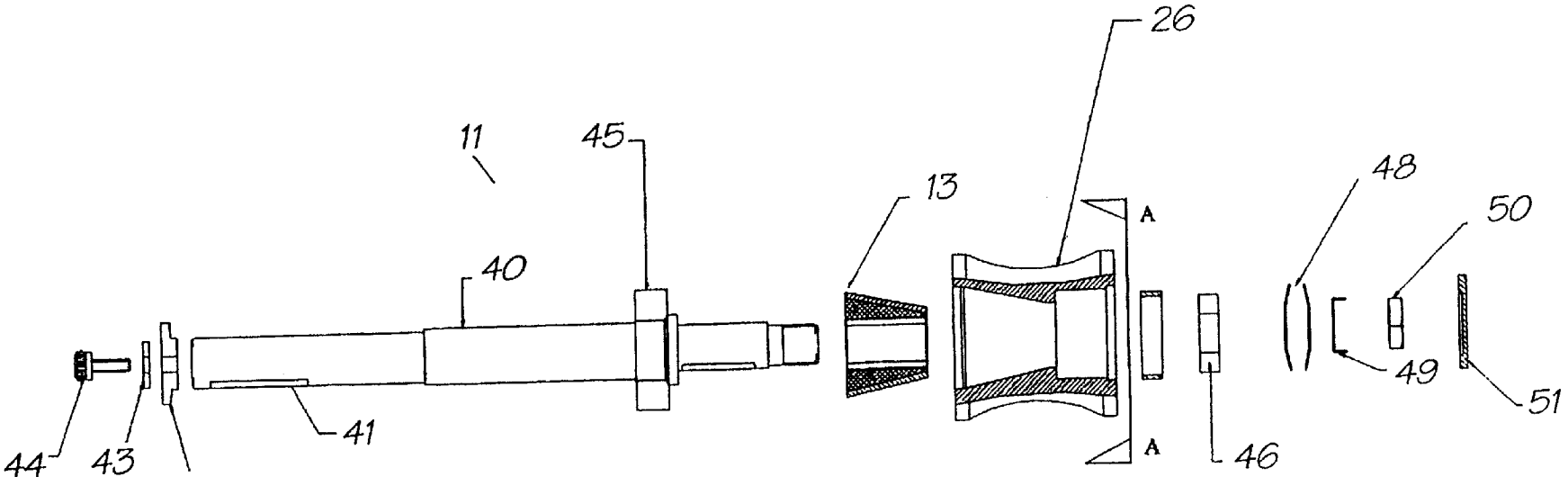
FIG. 8 is an exploded plan view of the core capstan arrangement and main shaft.
Figure 9:
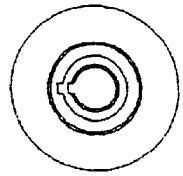
FIG. 9 is an end plan view of a portion of the arrangement of FIG. 8.

Turning to FIGS. 8 and 9, there is illustrated in FIG. 8 an exploded plan view of the capstan 11 and in FIG. 9 an assembled end view is shown. The outer surface of the capstan 26 preferably includes a hardened chrome serrated finish and engages a cone clutch mechanism formed by inner cone portion 13.

The cone portion 13 is inserted into one end of the outer capstan 26 and a main shaft 40 is inserted inside the cone. The main shaft 40 includes a keyway 41 which engages the output of the gear box arrangement (8 FIG. 1). The main shaft 40 is retained in position by means of retaining washer 42, washer 43 and a socket screw 44. Importantly, a bearing 45 is provided around main shaft 40, the bearing 45 acting on an internal surface of the cylinder 17 of FIG. 1 so as to transmit any non-tortional forces on the main shaft 40 to the frame via the cylinder 17.

A second bearing 46 is inserted into capstan 11 so as to provide for the transmission of non-torsional forces from the capstan to the main shaft. The setting of the torque limit of the capstan arrangement is provided by means of discs 48 and tab washer 49 which are fixed in position by means of lock nut 50. A tamper proof cap 51 is also provided so as to secure one end of the capstan 11 from tampering.

Figure 10:
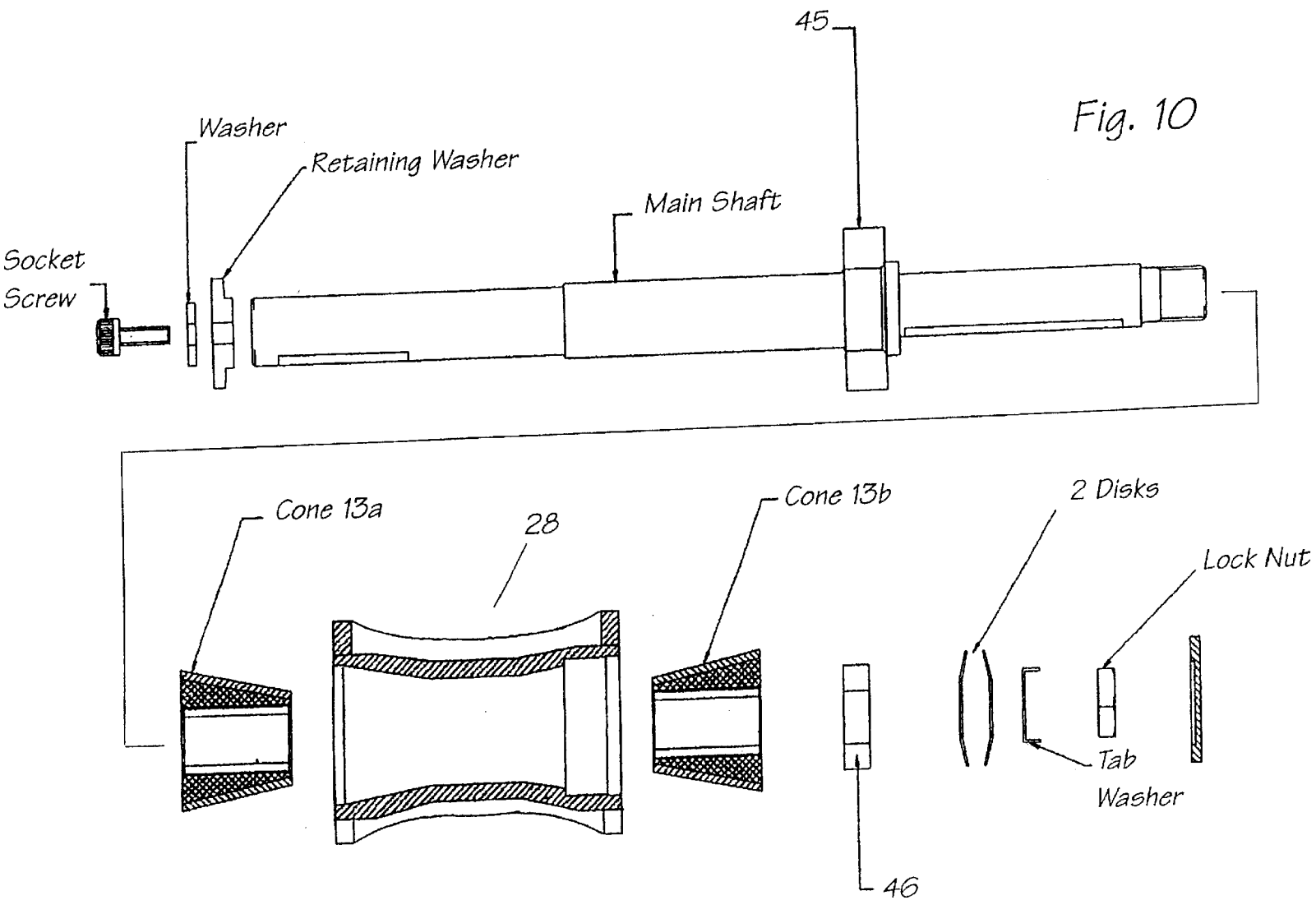
FIG. 10 illustrates an exploded plan view of a modified dual cone clutch arrangement suitable for use in an embodiment of the invention.
Figure 11:
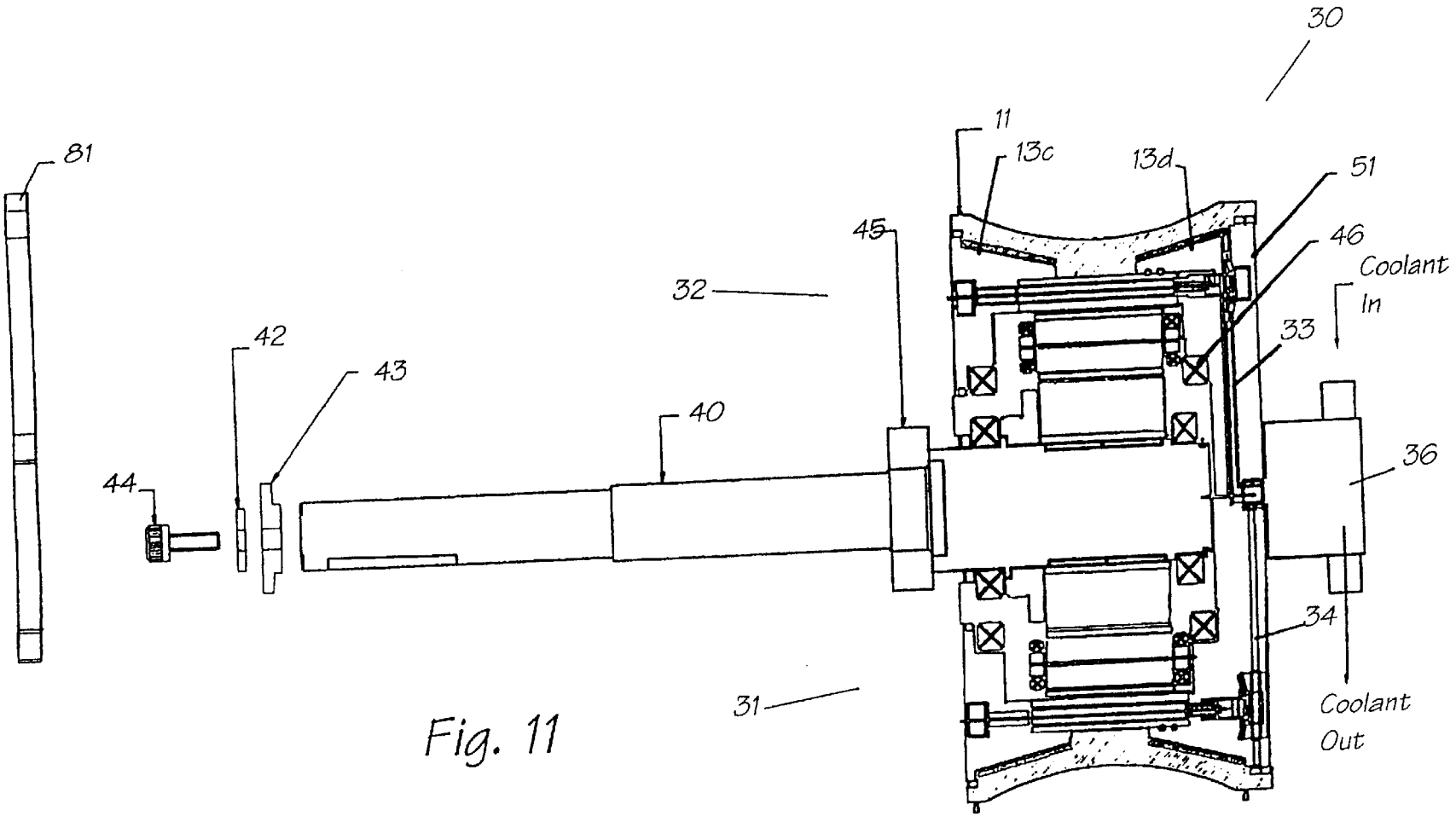
FIG. 11 illustrates a water cooled cone clutch arrangement suitable for handling the heavy duty loads in an embodiment.

Of course, other torque limiting clutch arrangements are possible. For example, in FIG. 10, there is illustrated an exploded plan view of a perspective dual cone clutch mechanism having a larger capstan 28 for heavier duty operations. The larger capstan is driven by dual cone arrangements 13*a* and 13*b*. The other portions of the arrangement of FIG. 10 being as previously discussed. Still large arrangements are possible. For example, in FIG. 11, there is illustrated a still larger dual clutch cone mechanism suitable for utilization in even heaver duty operations. The cone clutch mechanism 30 includes its own internally sealed gear reducers 31, 32 in addition to coolant flow chambers 33, 34 which pump fluid around the internal cone mechanism. A separate coolant flow unit 36 being provided for pumping cooling fluid around the capstan 30. The arrangement of FIG. 11 is particular useful for handling heavy excessive loads where slipping and hence heating may be prominent. The enlarged arrangement of FIG. 11 is ideally supported by the Y frame configured winches previously discussed with reference to FIG. 6.

Figure 12:
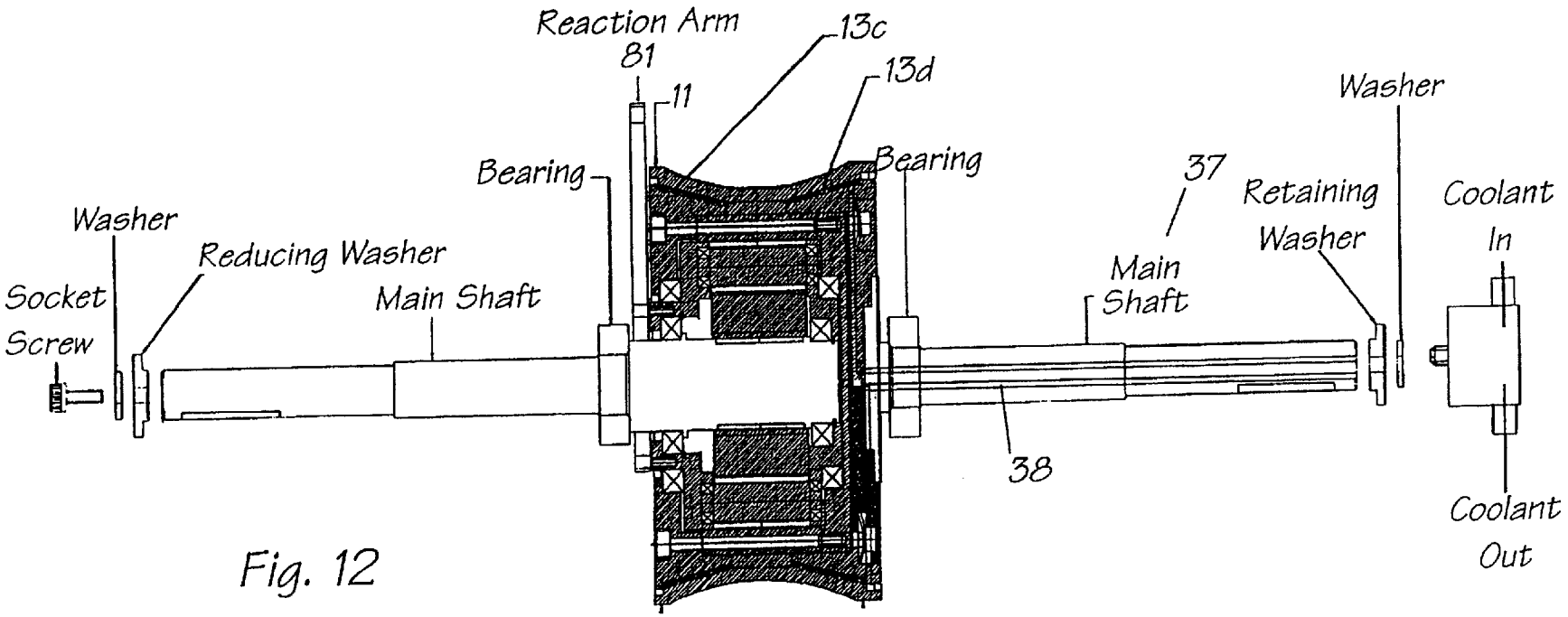
FIG. 12 illustrates a water cooled clutch mechanism including dual main shafts.
Figure 13:
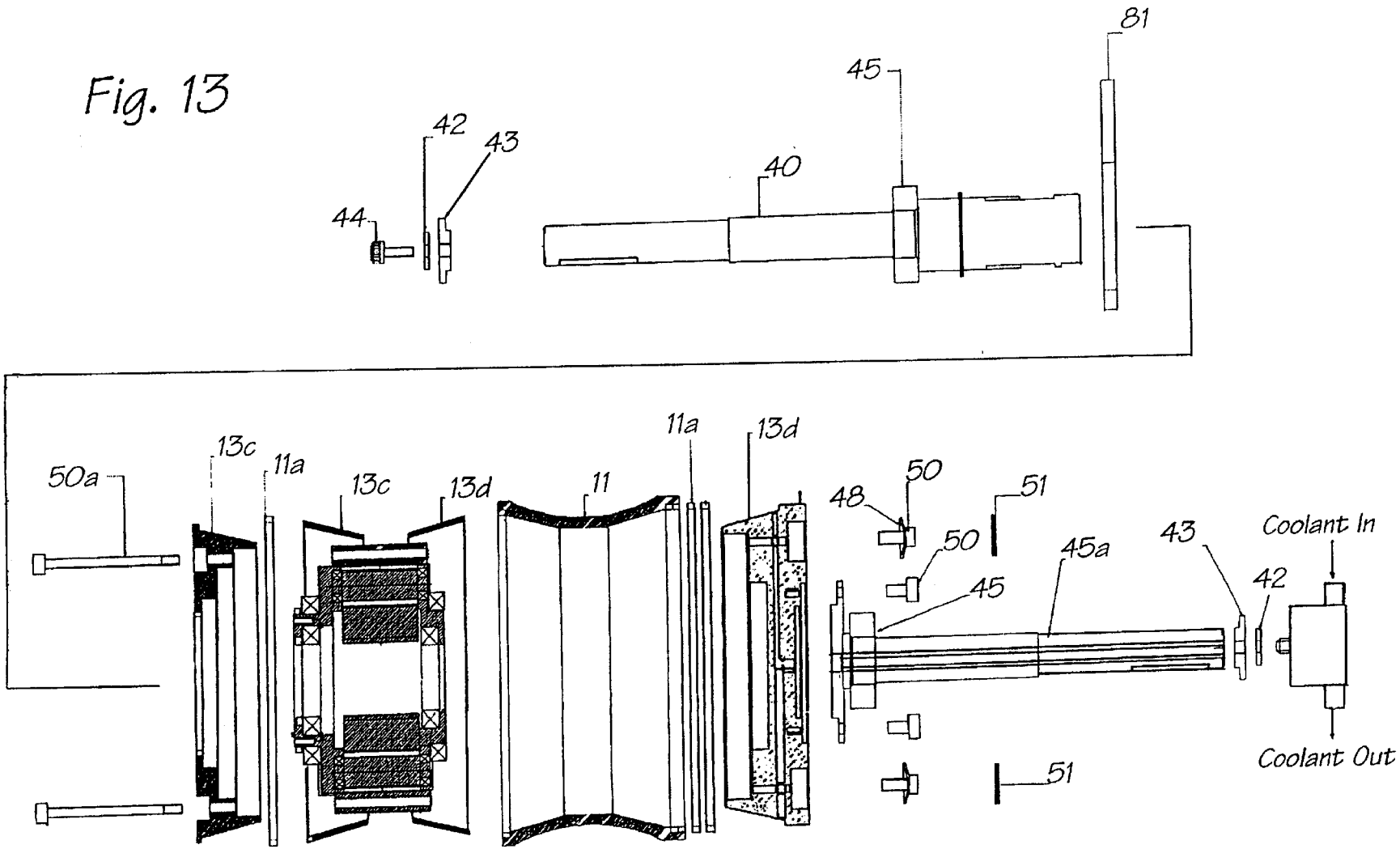
FIG. 13 is an exploded plan view of the arrangement of FIG. 12.
Figure 14:
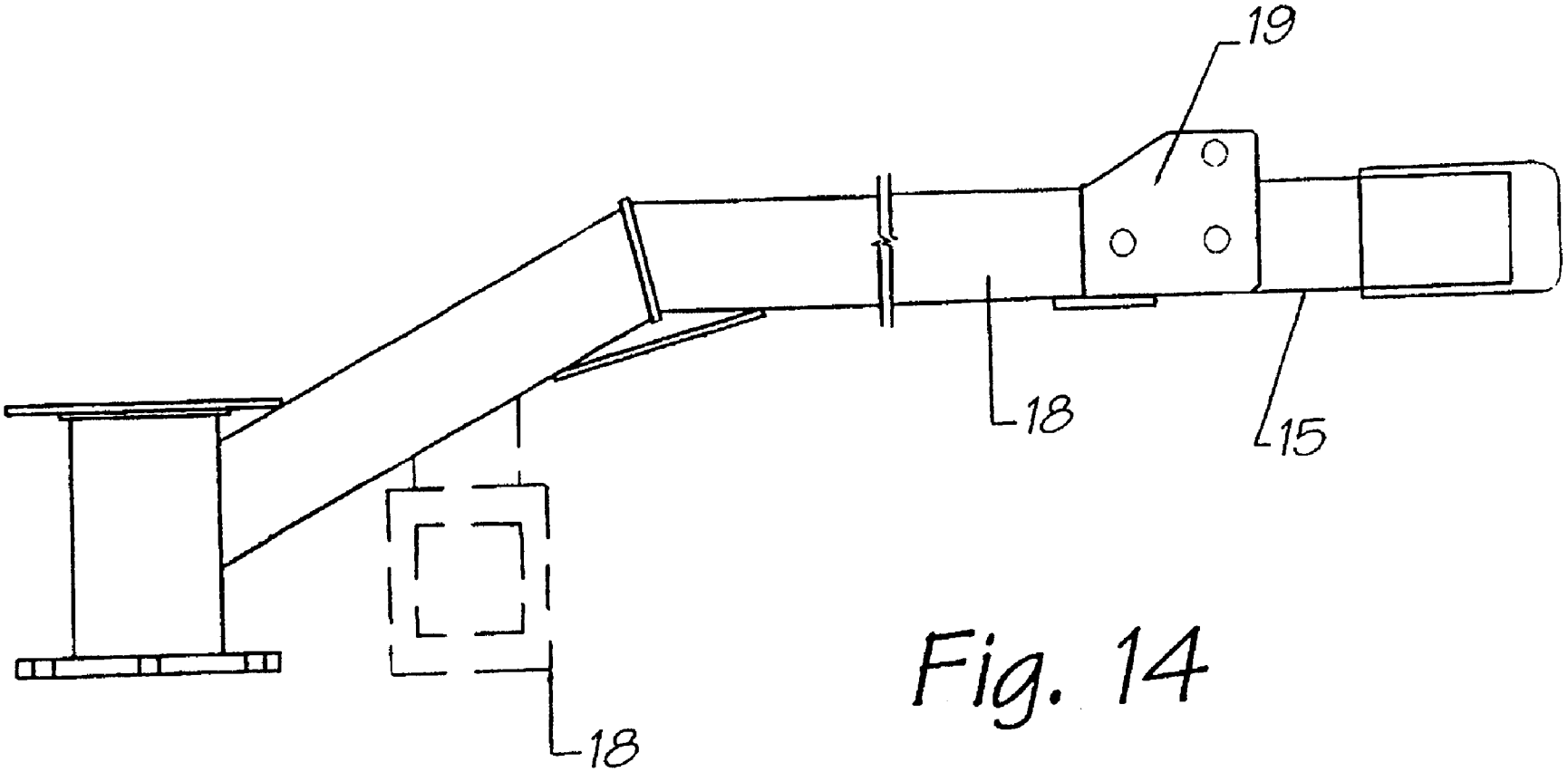
FIG. 14 illustrates the cylinder supporting strut of the preferred embodiment.

FIG. 12 illustrates a further alternative capstan arrangement of FIG. 11 extended to include a second shaft 37 having a series of internal coolant carrying conduits 38. FIG. 13 illustrates an exploded perspective of the arrangement of FIG. 12 showing the components in more details.

The utilisation of the cone clutch within the capstan can be set so as to provide for clutch operation only up to a maximum torsional limit. It will be therefore evident that the capstans disclosed are designed with a pre-loaded cone clutch where its torque limits the maximum tension/applied force in rope/cable hauled. The second torque limiter 6 between the prime mover and gear reducer is set at a slightly higher torque to ensure that the primary torque limiter does not exceed manufacturers hauling/loading specifications (this also accommodates for drive train inefficiencies). As shown in FIG. 1, the radial load due to the rope/cable hauled will take a straight line from centre of the curved profile on the capstan 11 through to the fastening fixing/anchoring device 15. This ensures that the force generated by the ropes/cables are in line and coupled directly via the frame/chassis with the fixing/anchoring device which takes up the reaction force. Thus, no excess turning moment is induced on the system via capstan 11. The frame/chassis carries tension/applied force via the radial bearings 45, 46 to cylinder 17 and transfers applied forces through to the towing tongue/pintel hook or fixing device. Thus the gear reducer 8 only transfers pure torsion from the prime mover or motor 3 through the shaft. The gearbox 8 therefore does not carry any overhung loads. The safety of the system is also improved by having the gear reducer radial load taken up by a radial bearing installed independently in the frame/chassis and offset from the reducer via the cylinder.

The capstan 11 can be made of a hard faced corrosion and abrasion resistant material having a serrated finish to prolong its working life.

The preferred embodiment has been designed into it to allow for direct winching loads for force or torque, Bi-directional and undirectional motion, including overriding and irreversible motion of the capstan.

The maximum force to be applied to a cable/rope is set/calibrated on the torque limited capstan 11. The capstan is a primary torque limiting device that ensures application forces are not exceeded. The capstan obviously slips when the applied force/tension in the rope exceeds the maximum tension the torque limited capstan is calibrated at. An enclosed second torque limiter 6 between the prime mover and the gear reducer, set at a slightly higher torque reading, and in the event of malfunction of the primary torque limiting device, this second torque limiter disengages positively and activates a micro switch to stop the prime mover 3 and/or raise an alarm. The objective of this process is to ensure that tensions in the rope/cable are not exceeded and guarantee that the characteristics of ropes/cables are maintained as stipulated by the manufacturer.

As noted previously, the capstan 11 has designed into it a sealed cone clutch that can be preloaded via a resilient disk (belville) washers which acts on a bearing to eliminate wear. The preload is maintained on the cone clutch via the disk washer and bearing locked in position on its shaft with a tab washer 49 and lock nuts 50. The cone clutch material is preferably selected to give long life which allows it to bed into the capstan bore if any slip occurs. This preloaded capstan can be re-calibrated for checking or new tension settings.

The capstan assembly complete with its keyed shaft is preferably located onto a "seal for life" bearing housed in the frame/chassis on one end and a bolted gear reducer 8 concentrically located on the other end of the frame/chassis hub via a spigot and flange arrangement.

Figure 15:
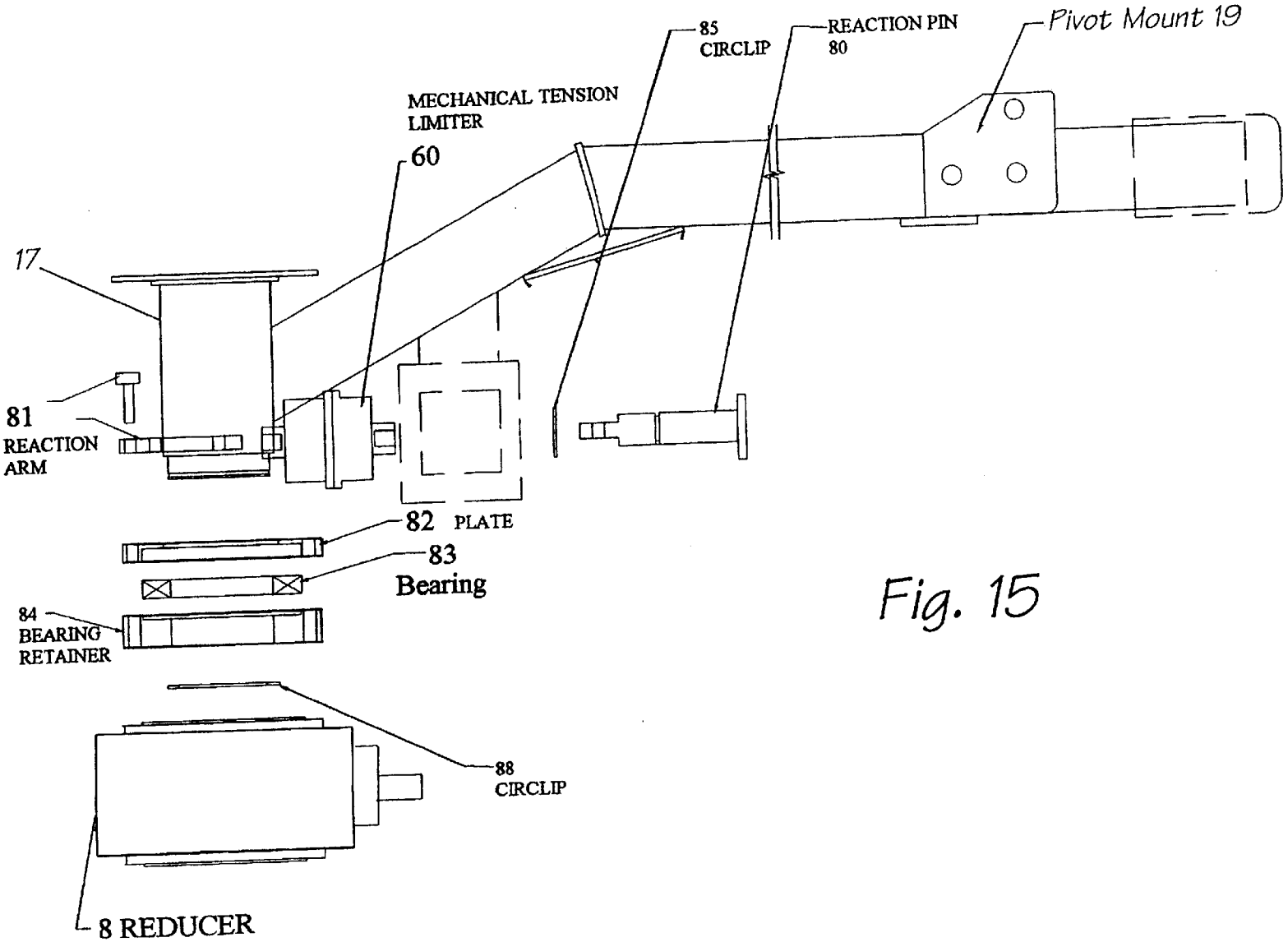
FIG. 15 is an exploded plan view of the cylinder supporting strut and mechanical tension limiter used in a modified embodiment.
Figure 16:
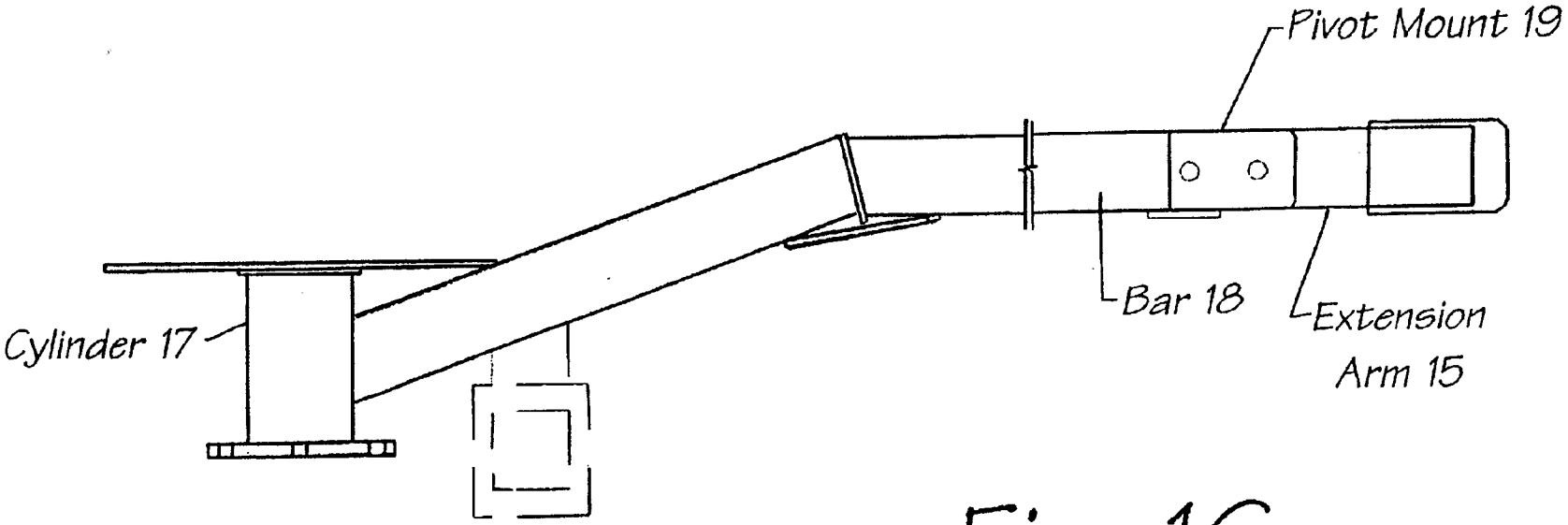
FIG. 16 illustrates a supporting strut and cylinder having an enlarged capstan carrying capability.
Figure 17:
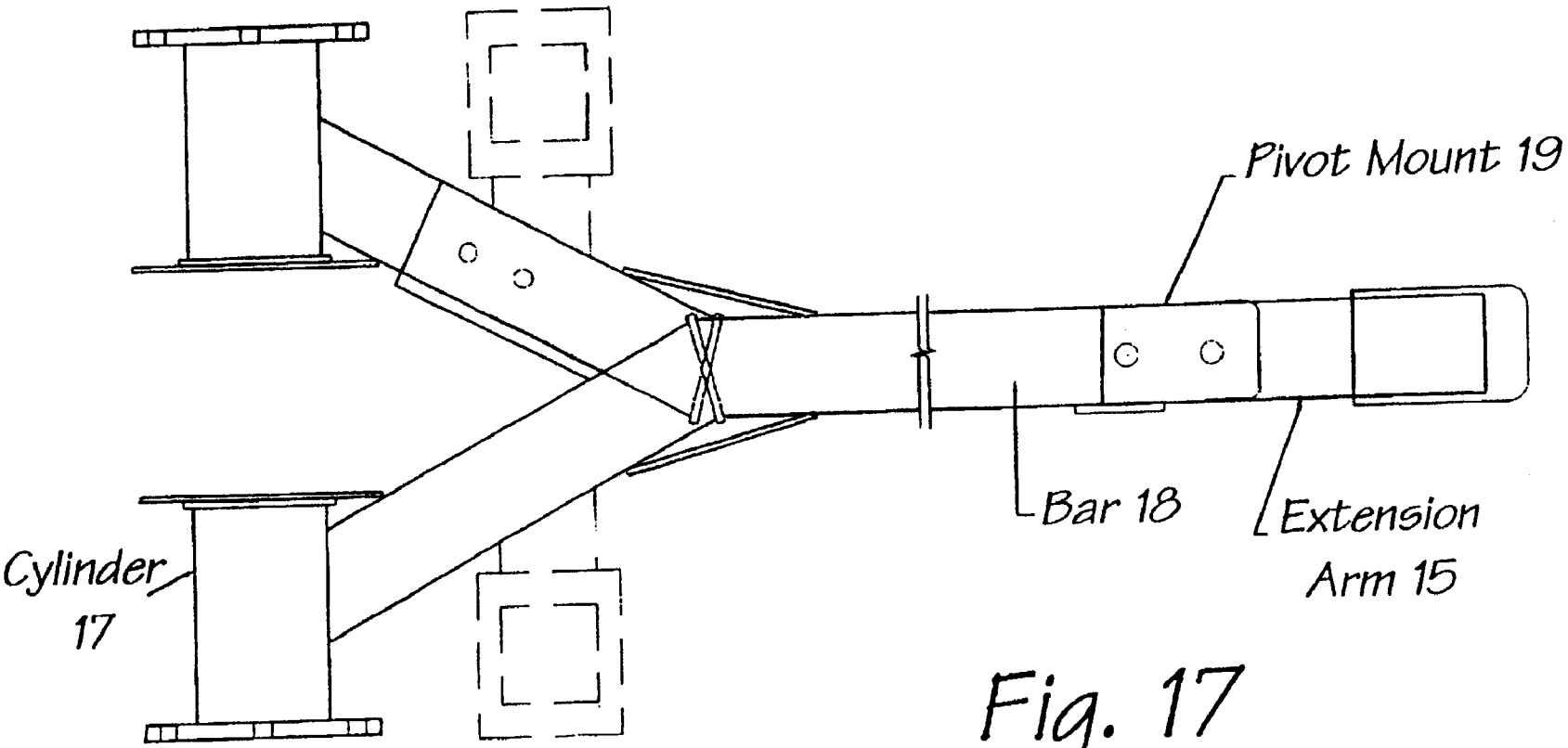
FIG. 17 illustrates the supporting struts of a dual cylinder arrangement.
Figure 18:
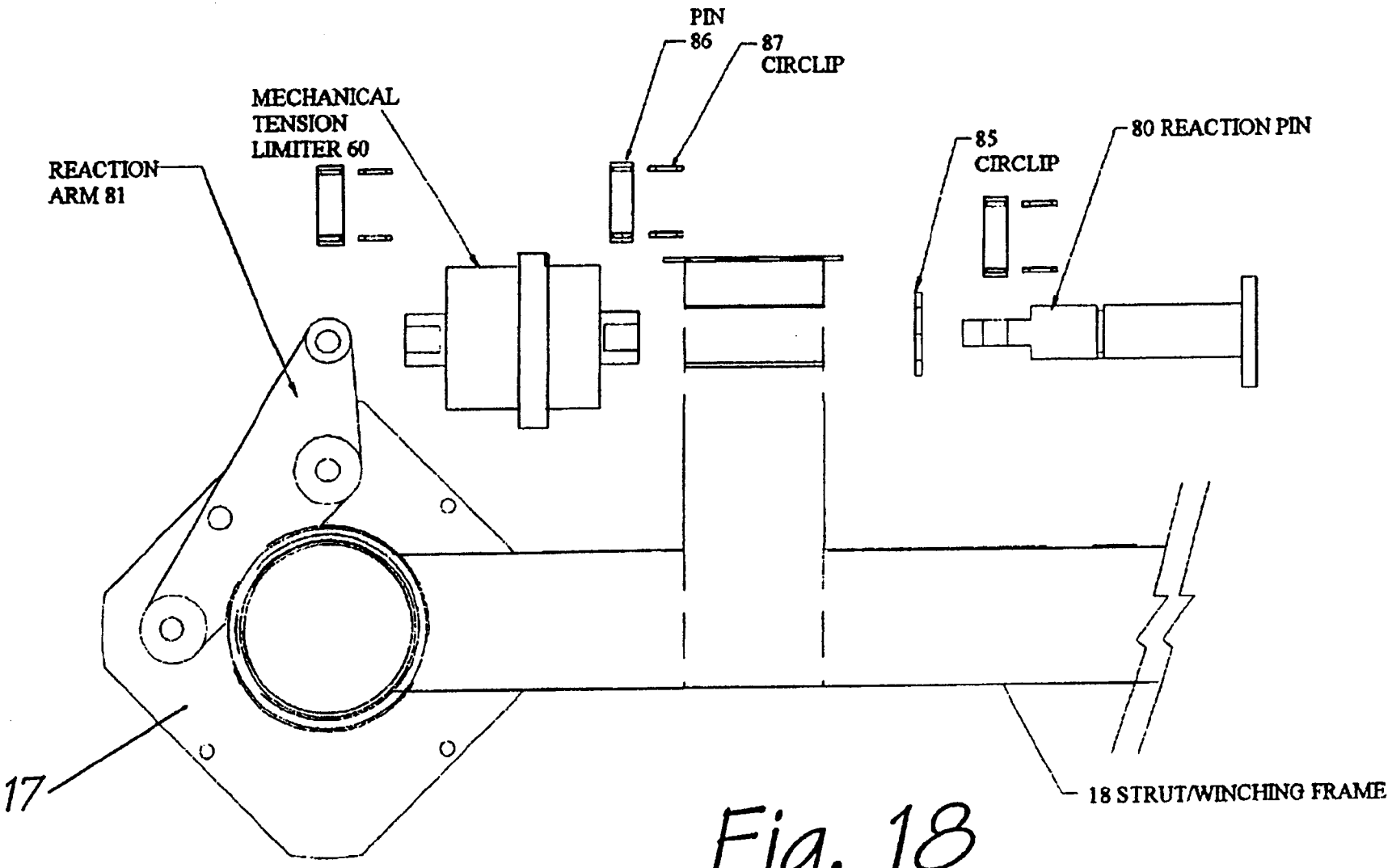
FIG. 18 is an exploded plan view illustrating the mechanical tension limiter.

It is noted previously, alternative embodiments of the present invention can also include an additional mechanical tension limiter, the details of which are shown in more detail in FIG. 15 which illustrates, in a partially exploded form, the mechanical tension limiter 60 which interconnects with a reaction arm 81 which are connected to the cylinder 17 by means of plate 82, bearing 83 and bearing retainer 84. The system being interconnected intermediate of the cylinder 17 and gear reducer 8. FIG. 18 shows an alternative form of mounting of the mechanical tension limiter 60 which again is shown in partially exploded perspective form and interconnects with a reaction arm 81 which is mounted on the gear reducer 8 or on bearing secured to the cylinder 17.

Figure 19:
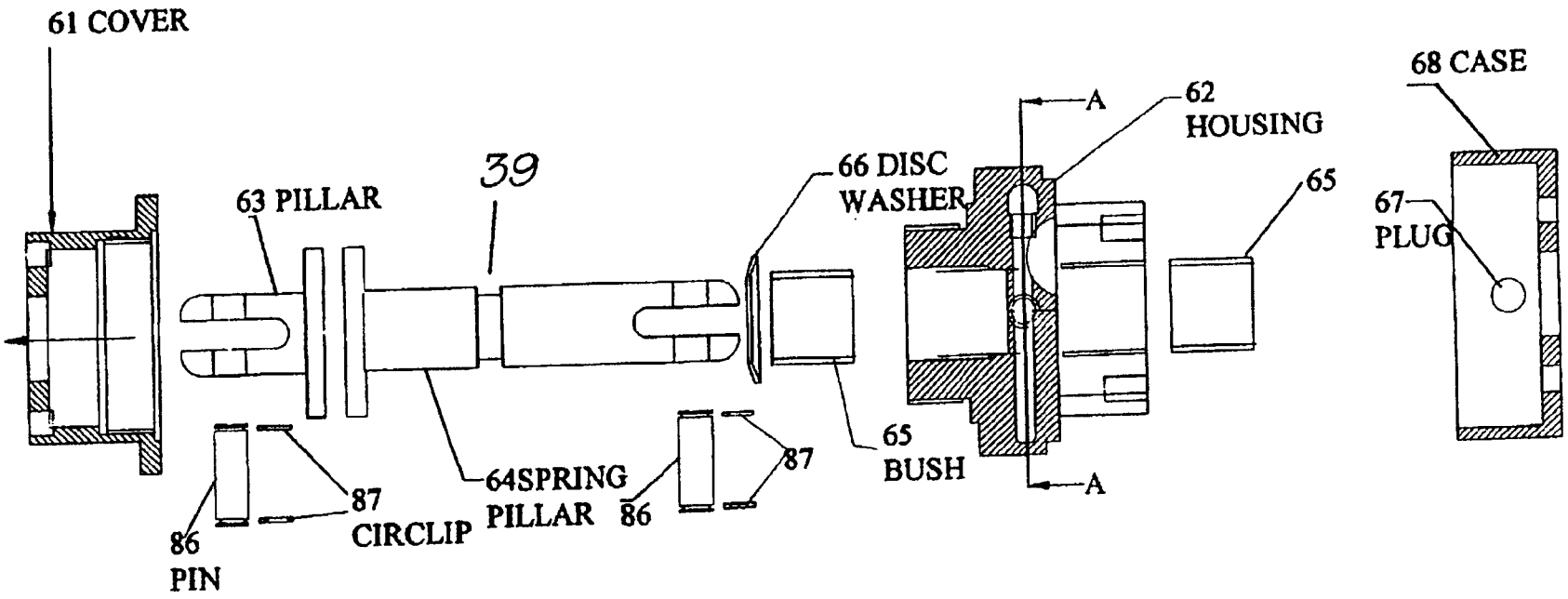
FIG. 19 is an exploded plan view of the mechanical tension limiter.
Figure 20:
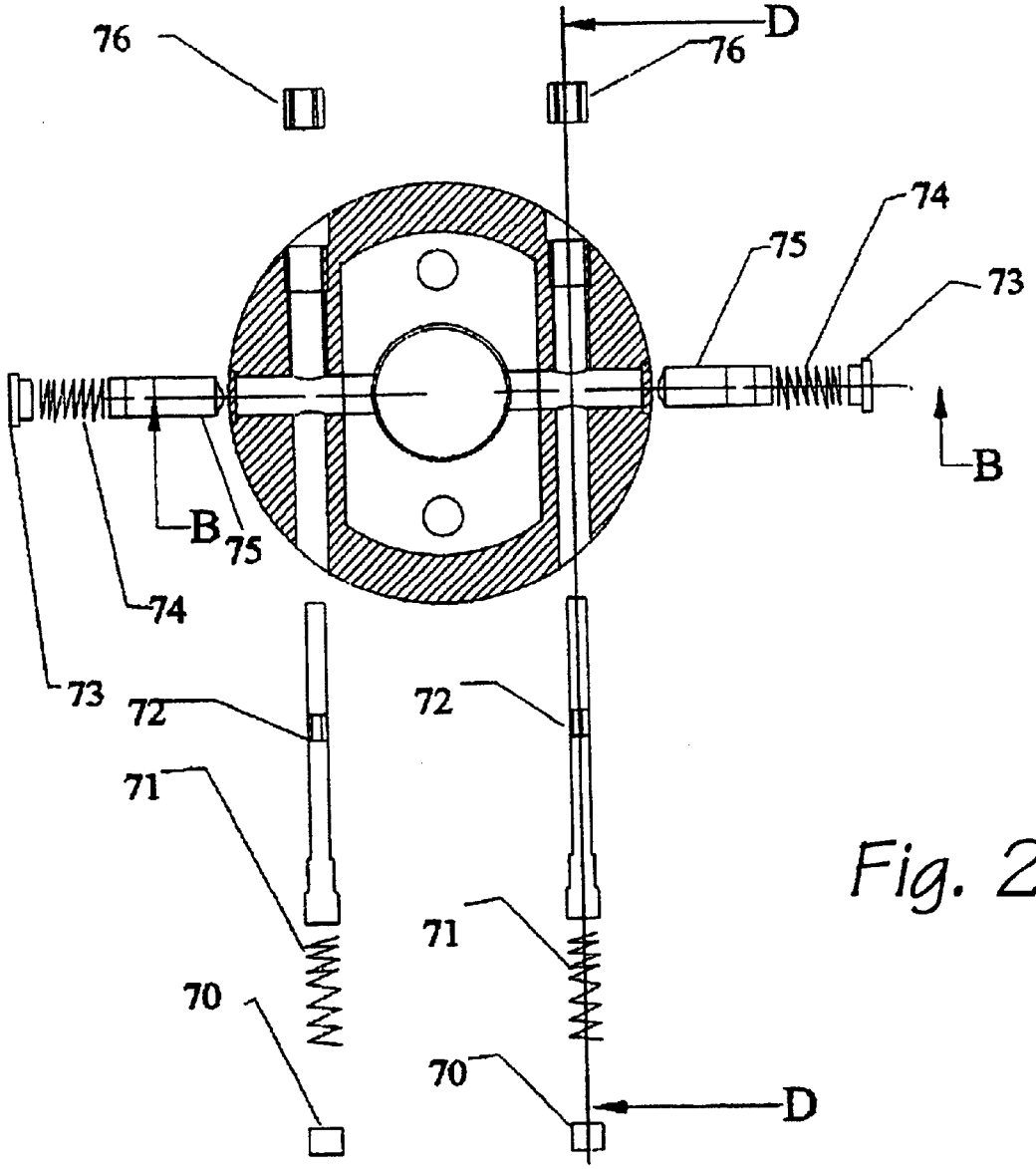
FIG. 20 illustrates the firing mechanism of the mechanical tension limiter.
Figure 21:
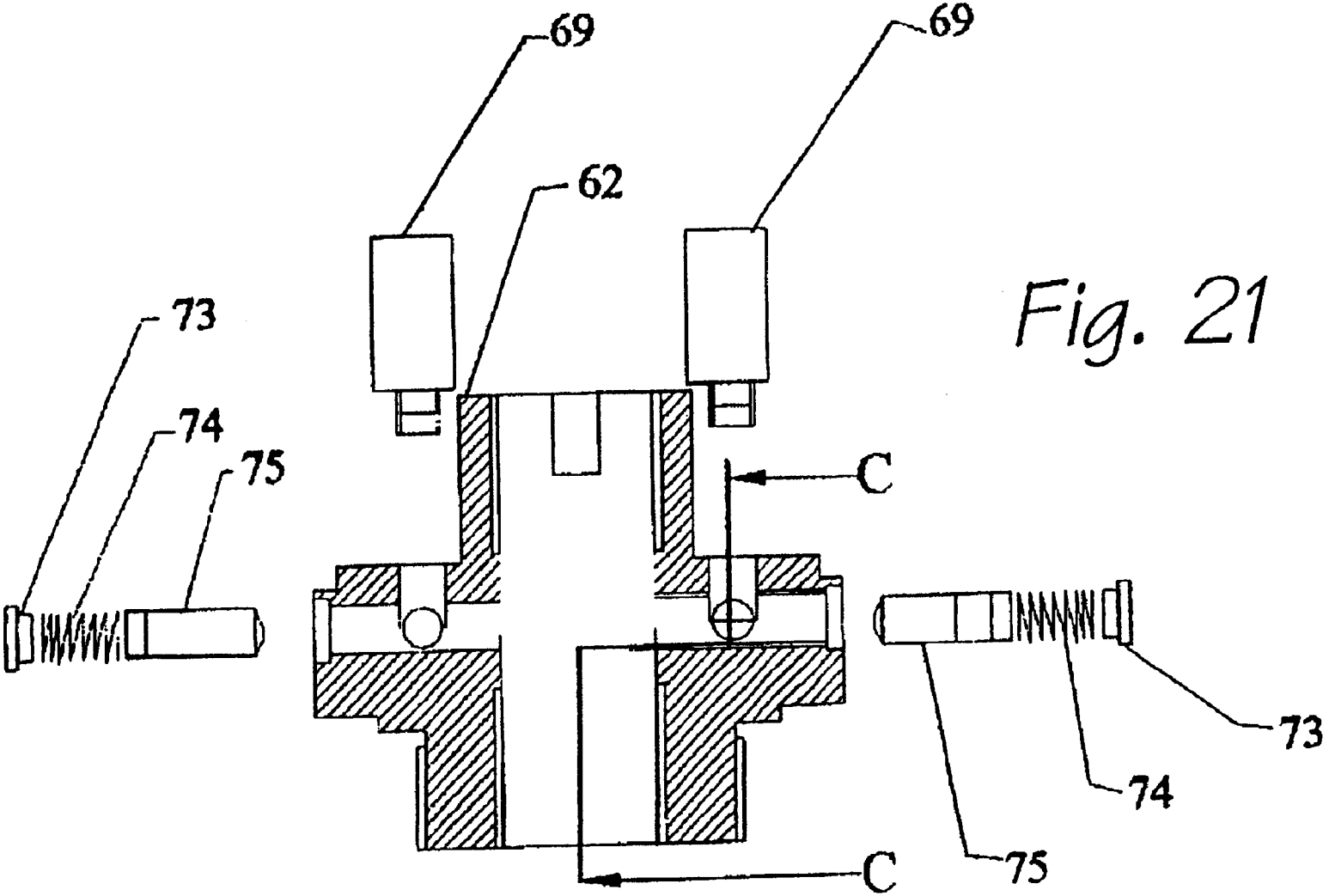
FIG. 21 is a further illustration of the mechanical tension limiter firing mechanism of a modified embodiment.
Figure 22:
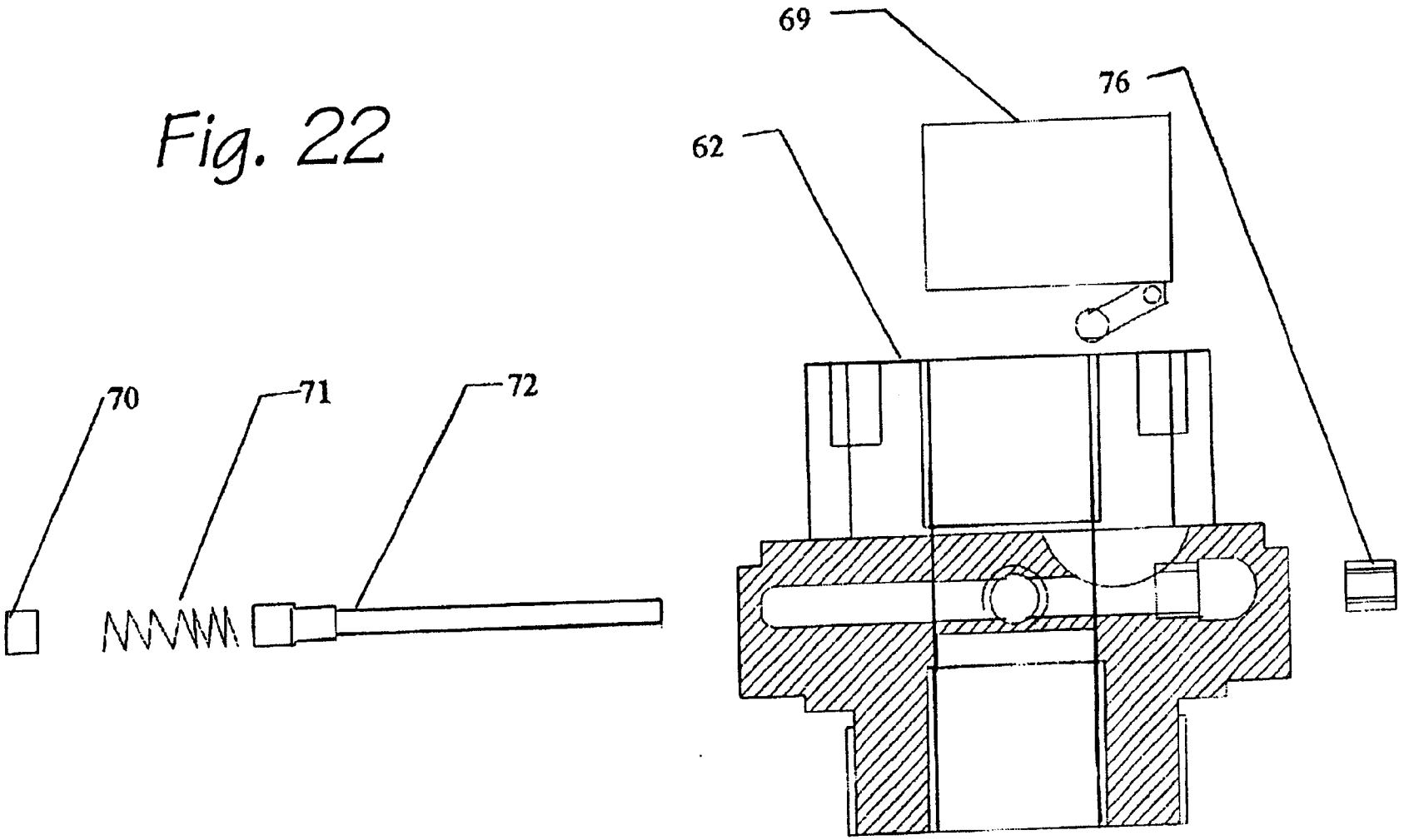
FIG. 22 is a further illustration of portion of the mechanical tension limiter of a modified embodiment.

The operation of the additional mechanical tension limiter will be described with reference to FIGS. 19–22 with FIG. 19 illustrated an initial exploded plan view of the mechanical tension limiter, FIG. 20 illustrating a sectional plan view through the line A—A of FIG. 19, FIG. 21 illustrating a sectional view through the line B—B of FIG. 20 and FIG. 22 illustrating a section through the line C—C of FIG. 21.

The mechanical latching mechanism releases a spring loaded strike pin 72 to actuate a sealed micro switch 69 which automatically stops the prime mover when a further predetermined limit is exceeded. The mechanical tension limiter operation is dictated by the applied force from the reaction arm 81 connected to the swivelling gear reducer positively located on cylinder 17. The applied force translates through the spring pillar 64 which compresses the disc washer 66. The edge of the spring pillar 64 is set a specified distance relative to the proportional elastic deflection of the disc washer 66. For example, a 5 kN deflection is reflected by a 0.5 mm deflection (in compression) of the disc washer 66 and spring pillar 64 respectively. The edge of the spring pillar 64 lifts the spring loaded main pin 75 and allows the spring loaded strike pin 72 to deflect across the main pin 75 hole to lift the bell crank of the limit switch 69 with stops the prime mover. The other micro-switch can be set at a higher tension to stop the prime mover when the preferred embodiment malfunctions in accordance with the winching code/regulations of the country and state the winching apparatus operates in.

Figure 23:
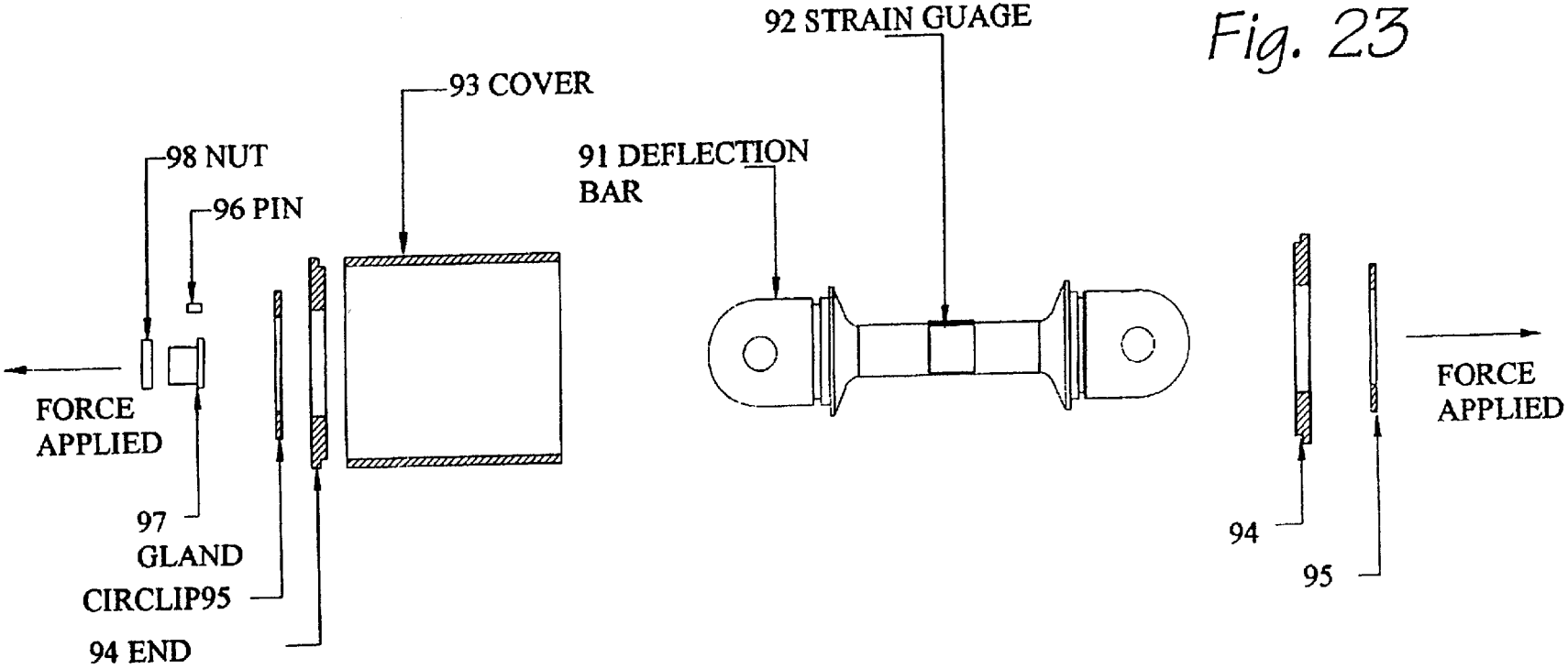
FIG. 23 illustrates the strain gauge of a modified embodiment.
Figure 27:
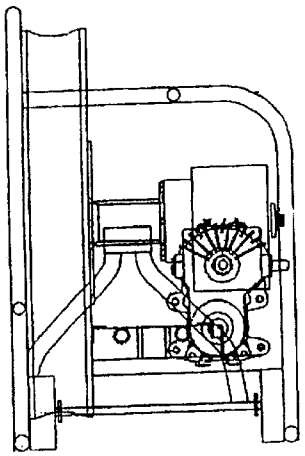
FIG. 27 is a front side view of a modified embodiment.
Figure 25:
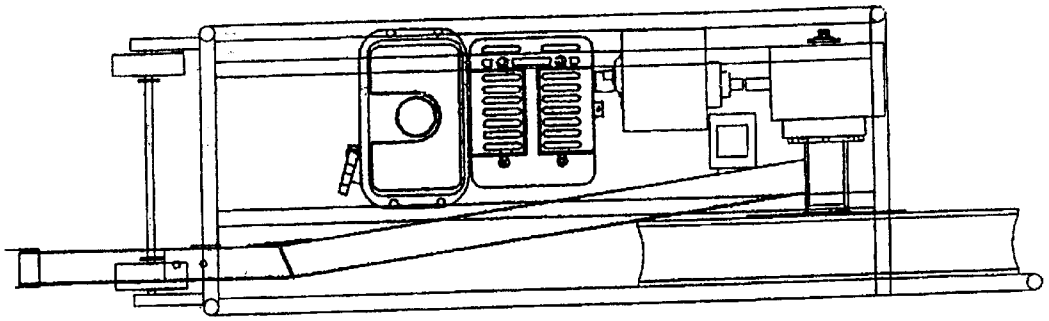
FIG. 25 is a top plan view of a modified embodiment.
Figure 26:
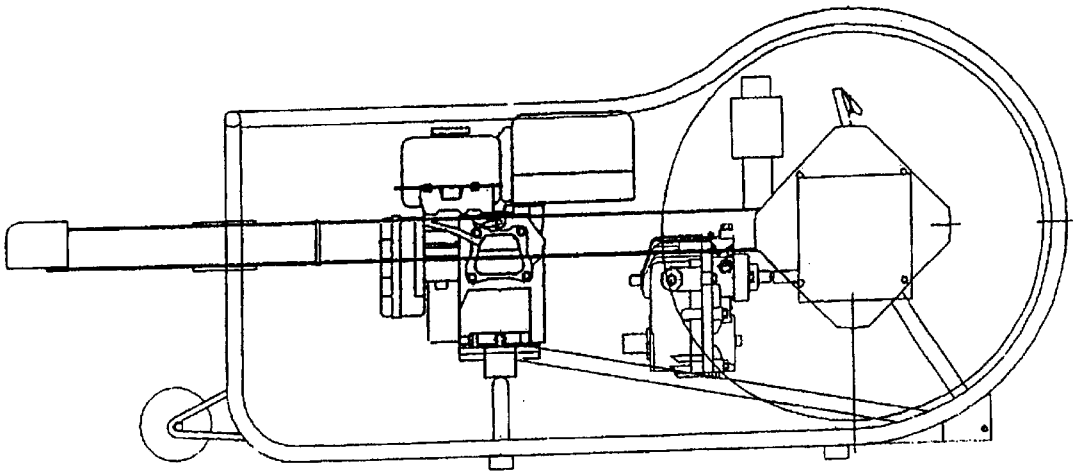
FIG. 26 is a side plan view of a modified embodiment.

In a further modification, a strain gauge/load cell as illustrated in FIG. 23 can be connected in series with the mechanical tension limiter to allow a load generated via the strain gauges 92 permanently mounted on the deflection bar 91 to be recorded via amplifier signal conditioning system. The deflection bar is housed in the cover 93, the end plates 94 and held in place by the circlips 95. The signal is transmitted via the coaxial cable 99 to the amplifier signal conditioning system.

Returning to the earlier drawings, the keyed input shaft of the gear reducer 8 locates the secondary torque limiter 6 which has an adjustable torque settings. If the primary torque limiter tension in the capstan is fouled or exceeds the specification set by the rope/cable manufacturer, the secondary torque limiter positively disengages the input shaft to the gear reducer and thus also the capstan. Also, as the torque limiter disengages a location disk moves a set distance, and a micro switch is actuated which automatically stops the prime mover.

Although different forms of motor can be used, the motor 3 is preferably keyed and connected to the secondary torque limiter clutch 6. The motor is located and anchored on the frame/chassis and concentrically aligned with the axis of the input shaft to the gear reducer.

Two rope guides 23 can be located around the capstan to assist with centring the position of the cable/rope and assist the operator during use.

An emergency stop button 24 can be located near but above the capstan, visual in a 360° horizontal plane.

The Winch is mounted in a roll cage e.g. 2 to protect it from mechanical damage.

The extension arm 15 also allows for an increase in the length of the frame/chassis reducing the lifting effort by the operator. Furthermore, when the winch is stored, the extension arm 15 can be positioned across the front of the engine for convenience and storage.

It will be obvious to those skilled in the art that the operation of the preferred embodiment has direct application to many different fields where pulling of cables or ropes is required. For example, the following list comprises a few of the applications of the present invention which will be readily apparent to those skilled in the art.

| | |
|---|---|
| Communication & Power | Hauling cable |
| Rescue & Fire Brigade | Rescue operations and clearing |
| Four wheel driving | Pulling the 4WD out of ruts |
| Agriculture | Pulling farm equipment, ancillary items out of precarious positions |
| Fishery | Nets & boating |
| Maritime | Boats and hazardous/foreign solids in the water |
| Forestry | Logging and equipment |
| Construction | Materials and equipment |
| Mining | Equipment and pits, ROPS and FOPS operations |
| Military | Applications |
| Water | Dredging |
| Ancillary services | loading and unloading |

It can be readily evident that small or large capstans can be utilised to satisfy the regulations in force in each country.

Further, as an added safety feature, the preferred embodiment is provided with an emergency stop switch 24 at a centrally located point.

The preferred embodiment provides for a very effective and safe form of operation. Through the utilisation of a wet clutch arrangement which only engages after a certain level of revolutions have been reached, the engine 3 can be started at a low revolution level so that the main drive shaft is not engaged. Next, the cable to be hauled can be wound around capstan 11. The operator can then step back from the apparatus and separately increase the engine revolutions so as to engage the main engine whilst the operator is nowhere near the capstan surface 11. In this way, a much safer form of operation of the winching arrangement is provided.

It will be evident also that further modifications can be provided. For example, the strut 18 may contain a strain gage so as to provide an indicator of the stress with which the preferred embodiment operates.

It would be appreciated by a person skilled in the art that numerous variations and/or modifications may be made to the present invention as shown in the specific embodiments without departing from the spirit or scope of the invention as broadly described. The presently described embodiments are, therefore, to be considered in all respects to be illustrative and not restrictive.

What is claimed is:

1. A winching apparatus for winching a cable comprising:

(a) a winching frame;

(b) a capstan for winding the cable to be winched;

(c) a drive motor for driving said capstan; and (d) a first mechanical torque limiting mechanism for limiting the maximum torque on a winching load in operation to a first predetermined limit and for maintaining a substantially constant torque under load at said maximum torque, wherein said first mechanical torque limiting mechanism is located within said capstan.

2. A winching apparatus as claimed in claim 1 wherein said mechanical torque limiting mechanism comprises a clutch mechanism.

3. A winching apparatus as claimed in claim 2 wherein said capstan is liquid cooled.

4. A winching apparatus as claimed in claim 1 wherein said first mechanical torque limiting mechanism comprises a cone clutch mechanism.

5. A winching apparatus as claimed in claim 4 wherein said cone clutch is adjustable so as to set said first predetermined limit.

6. A winching apparatus as claimed in claim 1 further comprising:

a second mechanical torque limiting mechanism located adjacent said motor for providing secondary disengagement of said motor from said capstan when the load on said capstan exceeds a second predetermined limit.

7. A winching apparatus as claimed in claim 6 further comprising a third mechanical torque limiting device which includes a latching mechanism actuated when said torsional load exceeds a third predetermined limit, said actuation being by a spring loaded strike pin which activates a switch which disables said driver motor.

8. A winching apparatus as claimed in claim 1 further comprising a gear reducer connected between said capstan and said drive motor.

9. A winching apparatus as claimed in claim 1 further comprising a fixing arm for fixing said winch to an object wherein said cable, said capstan, said fixing arm and said object are aligned during operation.

10. A winching apparatus as claimed in claim 9 wherein said fixing arm is pivotally mounted to said winching frame.

11. A winching apparatus as claimed in claim 1 further comprising:

at least one capstan support means interconnecting said capstan with a winching frame wherein non torsional forces on said capstan are communicated by said capstan support means to said frame.

12. A winching apparatus as claimed in claim 11 wherein the number of capstan support means is two.

13. A winching apparatus as claimed in claim 11 wherein the apparatus further comprises a fixing arm for fixing a winch to an object, and wherein said capstan support means is interconnected to said frame in substantial alignment with said cable, capstan and fixing arm.

14. A winching apparatus as claimed in claim 1 wherein said capstan includes an internal gear reducer unit for providing a great reduction driving of said capstan.

15. A winching apparatus as claimed in claim 1 further comprising a strain gauge for measuring the torsional load on said winching apparatus.

16. A winching apparatus as claimed in claim 1 wherein said first mechanism torque limiting mechanical is located inside said capstan in a sealed tamperproof manner.

17. A winching apparatus as claimed in claim 1 further comprising an external roll cage.

18. A winching apparatus as claimed in claim 1, wherein said capstan includes on a surface thereof an indicator of the torsional load operational characteristics of said capstan.

19. A winching apparatus as claimed in claim 18, wherein said indicator comprises a color indicator on the surface of said capstan.

20. A method of driving a capstan for winding a cable to be winched in a winching apparatus, the apparatus comprising:

(a) said capstan for winding the cable to be winched; and (b) a drive motor for driving said capstan, wherein the method comprises:

(A) activating said drive motor and setting said drive motor to a non-driving setting;

(B) loading said cable on said capstan for haulage by said winching apparatus; and (C) setting said drive motor to a driving setting so as to haul said cable, wherein said non-driving setting comprises a first number of revolutions per second of said drive motor and said driving setting comprises a second higher number of revolutions per second of said drive motor.

21. A winching apparatus for winching a cable comprising:

(a) a winching frame;

(b) a capstan for winding the cable to be winched;

(c) a drive motor for driving said capstan; and (d) a first mechanical torque limiting mechanism for limiting the maximum torque on a winching load in operation to a first predetermined limit and for maintaining a substantially constant torque under load at said maximum torque.

* * * * *